US006003862A

United States Patent [19]

Russell et al.

[11] Patent Number: 6,003,862

[45] Date of Patent: Dec. 21, 1999

[54] SIMPLIFIED SHEET TAMPING SYSTEM WITH FLEXIBLE GUIDED TAMPER DRIVE

[75] Inventors: Robert D. Russell, Pittsford; William J. Lavin, Fairport, both of N.Y.

[73] Assignee: Xerox Corporation, Stamford, Conn.

[21] Appl. No.: 08/907,988

[22] Filed: Aug. 11, 1997

[51] Int. Cl.[6] ..... B65H 31/36; B65H 31/26

[52] U.S. Cl. ..... 271/221; 271/220

[58] Field of Search ..... 271/221, 241, 271/220; 270/53.12, 53.13, 53.17

[56] References Cited

U.S. PATENT DOCUMENTS

| | | | |
|---|---|---|---|
| 5,098,074 | 3/1992 | Mandel et al. | 270/58.13 |
| 5,288,062 | 2/1994 | Rizzolo et al. | 270/58.12 |
| 5,524,873 | 6/1996 | Hosoi et al. | 271/221 |
| 5,620,178 | 4/1997 | Jung | 271/221 |
| 5,634,634 | 6/1997 | Dobbertin et al. | 271/221 |
| 5,639,078 | 6/1997 | Mandel et al. | 270/58.12 |

*Primary Examiner*—William E. Terrell
*Assistant Examiner*—Wonki K. Park

[57] ABSTRACT

An improved simple and low cost tamping system for a printed sheets compiling system directly driven by partial rotation of a reversible stepper drive motor driving a single molded plastic tamper drive unit. That tamper drive unit integrally includes a rigid radially extending portion rotatably driven by the drive motor, an elongate flexible member portion driven from one end by the rigid rotatable portion, and a tamper at the opposite end of the elongate flexible member. The elongate flexible member is slidably mounted in a fixed guides system to smoothly transition from an initial arcuate configuration to a final linear configuration to convert reversing partial rotational movement of the stepper drive motor into the desired substantially linear reciprocal sheet edge tamping movement of the tamper. Simply by rotating the stepper motor by a greater amount of rotation the desired initial position of the tamper can be reset when the sheet size or the desired stacking position of the sheets to be tamped is changed.

5 Claims, 1 Drawing Sheet

SIMPLIFIED SHEET TAMPING SYSTEM WITH FLEXIBLE GUIDED TAMPER DRIVE

Figure 1:
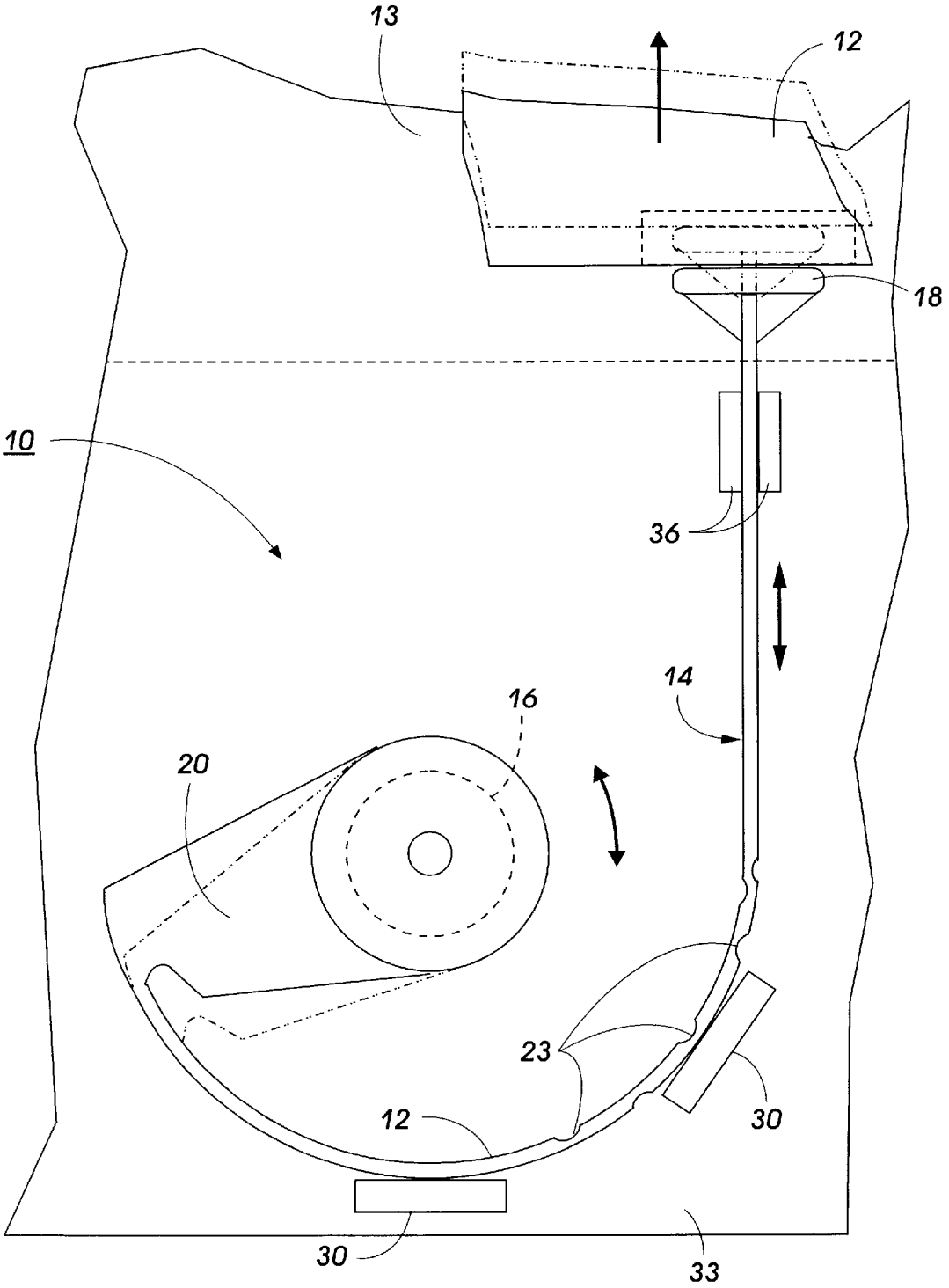

Disclosed is an improved, simplified, and low cost tamper for compiling sheets in various stacker or finisher applications.

In the disclosed embodiment, a simple rotary drive system such as a stepper motor rotary drives a single elongated flexible vane through a guide channel system to convert the rotary drive into a desired linear translation movements of a tamper, and to reposition the tamper into a desired tamping position, in contrast to more complex and expensive mechanisms which have been previously used for positioning and driving sheet tampers.

As is well-known in the sheet handling and compiling art, various tamping systems are utilized to repeatably reversibly move one or more generally vertical tamper arms or walls against one or both sides of an incoming sheet or set of sheets being compiled in a compiler or other tray, either as the individual sheets enter the compiler or tray to stack therein, or after the sheet or sheets have been ejected for stacking. Tamping causes the sheets to stack squarely superposed in a defined or registration position. One or more edges of the stack may be provided with such active tamping systems. Opposing stack edge registration systems with fixed walls may be utilized to define an opposing side of a stack being actively tamped on an opposite side, so that active tamping of only one side of the stack may be required. However, the present system can be used for active tamping on both opposing sides of a stack as well, if desired.

By way of background, some examples of patents relating to single set edge tamping include U.S. Pat. No. 5,044,625, 5,288,062; 5,188,353; 3,860,127; 4,134,672; 4,477,180; 4,480,825; 4,616,821; 4,925,172; 4,925,171; 5,098,074; and 5,044,625; and other art cited therein.

It is known that set edge tamping systems can be combined with other operations or used to provide other functions. For example, a tamper system may also provide what may be called "offsetting", of one set relative to another in the stack for separation, or offsetting of a stack from an initial compiling position into and/or out of a stapling or other finishing position. Examples are disclosed in Xerox Corporation U.S. Pat. Nos. 5,501,442 and 5,513,839, for example. Edge tampers may also be combined with orthogonal stack edge registration members movements, as in U.S. Pat. No. 5,639,078.

Typically, the tamper is actuated each time an additional incoming sheet is to be placed on the stack. It is easier to align the sheets to the stack one at a time rather than after plural sheets have been stacked misaligned or skewed, since the stacked sheets may be stuck together with attraction forces from electrostatic charges, etc. Thus, a sheets tamping system is subjected to considerable wear over its life, particularly where the sheets being compiled or otherwise stacked are the output of a high volume printer or copier. Component wear or mechanical tolerance variations in the tamping mechanism can cause the registration position of the stack to change undesirably. If the tamping system is to be alternatively or additionally utilized for sets offsetting, this imposes additional force and wear on the system. For finished sets accurate stack alignment is particularly critical, as customers are not accepting of books or other sets of bound sheets with skewed pages or uneven edges, misaligned punched holes, or other misstacking defects. Furthermore, the sizes of the sheets to be tamped can vary considerably, depending upon the size of paper selected to be printed and/or collated. Furthermore, even paper of presumably the same standard sizes can vary considerably due to tolerances in paper manufacturing, changes in dimensions with humidity or fusing, etc.

The present system is intended to provide advantages or accommodations for these and other difficulties in tamping systems with an extremely simple and low cost system as compared to numerous previous tamping systems, many of which are illustrated in the above-cited and other references in this long-standing art.

Specific features of the disclosed embodiment include a printed sheets compiling system in which plural flimsy sheets are stacked in a compiler and tamped by a sheet tamping system into squarely superposed stacks, said tamping system providing at least one tamper intermittently reciprocally moving towards and away from at least one edge of a sheet; the improvement in said tamping system wherein said tamping system comprises a rotatable drive motor providing reversible rotational movement; a defined length rotatable arm rotatably driven by said drive motor; an elongated flexible tamper drive member; said elongated flexible tamper drive member having a first operative end portion to which said tamper is integrally mounted; a second, opposing, operative end portion of said elongated flexible tamper drive member integrally mounted to said defined length rotatable arm to be rotatably driven by said defined length rotatable arm; and a tamper drive member guide system, in which guide system said elongated flexible tamper drive member is slideably mounted; said guide system with said elongated flexible tamper drive member converting said rotatable movement of said second operative end portion of said elongated flexible tamper drive member into a substantially linear movement of said first operative end portion of said elongated flexible tamper drive member to which said tamper is integrally mounted to provide said reciprocal movement of said tamper from said rotatable drive motor.

Other features of the disclosed embodiment include those wherein said guide system comprises fixed guide baffles for slideably engaging said elongated flexible tamper drive member; and/or wherein at least said second operative end portion of said elongated flexible tamper drive member is arcuate, and at least said first operative end portion is maintained substantially linear by said guide system; and/or wherein said defined length rotatable arm is substantially rigid, and wherein said rotatable arm and said elongated flexible tamper drive member are a single monolithic molded plastic unit; and/or wherein at least said second operative end portion of said elongated flexible tamper drive member is arcuate, and at least said first operative end portion is maintained linear by said guide system, and wherein said guide system comprises fixed guide baffles for slideably engaging said elongated flexible tamper drive member, with first guide baffles for maintaining said arcuate portion of said elongated flexible tamper drive member by slideably engaging the outer side thereof, and second guide baffles for slideably engaging opposing sides of said linear portion thereof adjacent said tamper.

By way of further general background, in reproduction apparatus such as xerographic and other copiers and printers or multifunction machines, it is increasingly important to provide faster yet more reliable automatic handling of the physical image bearing sheets. It is desirable to reliably and accurately register document and/or copy sheets of a variety and/or mixture of sizes, types, weights, materials, humidity and other conditions, and susceptibility to damage. In particular, it is desirable to minimize sheet skewing, jamming, wear or damage. The sheets which may be handled in or outputted from reproduction apparatus may have various differences and irregularities. Sheets can vary considerably even if they are all of the same "standard" size, (e.g. letter size, legal size, A-4, B-4, etc.). They may have come from different paper batches or have variably changed size with different age or humidity conditions, or different imaging, fusing, etc. Sheet misregistration or misfeeding can also adversely affect further feeding, ejection, and/or stacking and finishing.

The disclosed system may be operated and controlled by appropriate operation of conventional control systems. It is well known and preferable to program and execute paper handling and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs. It is well known that the control of document and copy sheet handling systems may be accomplished by conventionally actuating them with signals from a microprocessor controller directly or indirectly in response to simple programmed commands, and/or from selected actuation or non-actuation of conventional switch and/or sensor inputs. The resultant controller signals may conventionally actuate various conventional electrical or cam-controlled components, as is well known in the art.

In the description herein the term "sheet" refers to a usually flimsy physical sheet of paper, plastic, or other suitable physical substrate for images, whether precut or web fed. A "copy sheet" may be abbreviated as a "copy", or called a "hardcopy". A "job" is normally a set of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the example below of a description of one specific embodiment, including the drawing figures (approximately to scale) wherein:

FIG. 1 is a partially schematic top view of a subject exemplary tamping system, shown at one side of a partially illustrated conventional sheet stacking compiler, and shown with covers removed for clarity.

As illustrated in the FIGURE, an exemplary tamping system 10 is shown here for tamping one side of a stack 12 of sheets being compiled in the compiler tray of a compiler 13, as generally described above in connection with the cited prior art references, which may be referred to for further details. This tamping system 10 can be used in many different types of compilers or other sheet stackers, so compiler 13 is only partially shown here.

This tamping system 10 has a greatly reduced number of components, especially, moving parts. A partially flexible tamper drive unit 14 is rotatably driven by a drive motor 16, yet provides the desired linear tamping movement for an otherwise conventional sheet tamper 18 without requiring any other interconnecting mechanisms. This drive motor 16 is preferably a conventional stepper motor which can provide both the desired short reciprocal movement needed for sheet tamping for alignment of the sheet on the stack 12, and also provide the controllable initial positioning or repositioning of the tamper 18 for receiving various sizes of incoming sheets. (While tamping itself may require only a few mm of reciprocal movement, this initial tamper repositioning movement could be as much as 25 cm or more.) The motor 16 output shaft is directly connected to the inside end of a rigid drive arm 20 of a defined length to provide a defined radius, which arm 20 here is integral to the tamper drive unit 14. At the outer end of this rigid arm 20 there is integrally molded an elongated flexible vane portion 21 which extends all the way to the tamper 18, so that the entire unit 14 can be one single molded part, preferably of molded acetal or other suitable plastic. This flexible rotary vane member or portion 21 may be provided with additional hinge recesses 23 therealong, as shown, to make the member 21 thinner in the area of these recesses 23 to increase flexibility in those desired areas.

The initial portion of this elongate flexible member 21 of the tamper drive 14 is held in an arcuate position, to substantially the same radius as the rotating arm 20, by protruding guides 30 molded or otherwise mounted into a base frame 33 of or adjacent to the compiler 13 to define a slidable guide channel for this flexible member 21. The further extension of this flexible member 21 then unwraps to extend on linearly through linear guides 36 adjacent to the tamper 18. The linear guides 36 confine both sides of the outer end portion of the member 21 but also provide for the member 21 to freely slide therebetween. The tamper 18 can also be another integrally molded portion of the same single unit 14, albeit of the very different shape needed to provide a known suitable sheet edge tamping surface.

As shown, thereby this single unit 14 converts the rotary motion of the motor 16 in both directions into a directly corresponding but completely linear motion of the tamper 18 toward and away from the sheet to be tamped in (or upstream of) the compiler 13, somewhat similar to the movement of a motor driven tape measure in that limited respect. Since there are no gear tooth gaps or other indirectly corrected members between the motor and the tamper here, there is much less opportunity for slip or backlash in this reciprocal tamper drive. The rotary motion of the motor is converted into a straight line motion to tamp the entering copy sheet into the desired position for stacking and/or further processing such as stapling or offsetting. The single integral molded part 14 takes advantage of the flexibility of the acetal plastic member in its thin strip area 21 while still providing the strength and force transmission for the pushing and pulling of the tamper 18.

To summarize, a simple and low cost tamping system for a printed sheets compiling system is provided in which the tamper 18 is directly driven linearly by rotation of a reversible drive motor 16 driving an integral single molded plastic tamper drive unit 14 integrally including a defined length rigid rotatable arm 20 rotatably driven by the drive motor 16, an long flexible drive member 21 driven from one end by the rotatable arm 20, and a tamper 18 integral to the other end of the elongate flexible member 21. The flexible member 21 is slidably mounted in a fixed guides 30, 36 system and transitions from an initial arcuate to a final linear configuration to convert the rotatable movement of the drive motor 16 into the desired substantially linear movement of the tamper 18. That is, to convert reversing partial rotational movement of the stepper drive motor 16 into the desired substantially linear reciprocal sheet edge tamping movement of the tamper 18. An additional feature is that simply by rotating the stepper motor 16 by a greater amount of rotation the desired initial position of the tamper 18 can be reset when the sheet size and/or the desired stacking position of the sheets to be tamped is changed. Thus, no additional hardware, only a software and/or switch controlled signal to the motor 16, is needed to position or reset the tamper(s) 18.

It will be appreciated that the defined length rigid rotatable arm 20 can be provided by a substantially circular disc or plate rather than the partial disc illustrated. The defined radius extending from the axis of the motor 16 shaft to which the arm 20 is mounted out to the point of attachment of the end of the flexible member 21 to the arm 20 determines the circumferential movement of the member 21 for a given programmed angular movement of the stepper motor 16 shaft, which circumferential movement is directly converted here to a linear movement of the tamper 18.

Added elasticity or spring loading systems are not required, since if there is any inadvertent obstruction of the tamper 18, this system can simply provide temporary stalling of the stepper motor 16 drive through the same simple drive connection, and/or the obstruction be absorbed through flexibility built in to the unit 14 and/or its guides. Furthermore, the entire unit 14 may be easily removed and replaced quickly and at low cost if it should become worn or damaged.

It will be appreciated that the channel-defining guides or baffles 30 and 36 illustrated are merely schematic examples and that various suitable configurations can be provided. Here, guides 30 are illustrated only on the outside of the arcuate portion of the flexible member 21 since that is the side against which the flexible member 21 would be driven in the outward movement of the tamper for tamping, and the side against which this arcuate portion of the unit 14 is flexed.

While the embodiment disclosed herein is preferred, it will be appreciated that various alternatives, modifications, variations or improvements therein may be made by those skilled in the art, which are intended to be encompassed by the following claims.

What is claimed is:

1. In a printed sheets compiling system in which plural flimsy sheets are stacked in a compiler and tamped by a sheet tamping system into squarely superposed stacks, said tamping system providing at least one tamper intermittently reciprocally moving towards and away from at least one edge of a sheet; the improvement in said tamping system wherein said tamping system comprises:

a rotatable drive motor providing reversible rotational movement, a defined length rotatable arm rotatably driven by said drive motor, an elongated flexible tamper drive member, said elongated flexible tamper drive member having a first operative end portion to which said tamper is integrally mounted, a second, opposing, operative end portion of said elongated flexible tamper drive member integrally mounted to said defined length rotatable arm to be rotatably driven by said defined length rotatable arm, and a tamper drive member guide system, in which guide system said elongated flexible tamper drive member is slideably mounted, said guide system with said elongated flexible tamper drive member converting said rotatable movement of said second operative end portion of said elongated flexible tamper drive member into a substantially linear movement of said first operative end portion of said elongated flexible tamper drive member to which said tamper is integrally mounted to provide said reciprocal movement of said tamper from said rotatable drive motor.

2. The compiling system of claim 1 wherein said guide system comprises fixed guide baffles for slideably engaging said elongated flexible tamper drive member.

3. The compiling system of claim 1 wherein at least said second operative end portion of said elongated flexible tamper drive member is arcuate, and at least said first operative end portion is maintained substantially linear by said guide system.

4. The compiling system of claim 1 wherein said defined length rotatable arm is substantially rigid, and wherein said rotatable arm and said elongated flexible tamper drive member are a single monolithic molded plastic unit.

5. The compiling system of claim 1 wherein at least said second operative end portion of said elongated flexible tamper drive member is arcuate, and at least said first operative end portion is maintained linear by said guide system, and wherein said guide system comprises fixed guide baffles for slideably engaging said elongated flexible tamper drive member, with first guide baffles for maintaining said arcuate portion of said elongated flexible tamper drive member by slideably engaging the outer side thereof, and second guide baffles for slideably engaging opposing sides of said linear portion thereof adjacent said tamper.

* * * * *